US006250508B1

(12) United States Patent
Geser et al.

(10) Patent No.: US 6,250,508 B1
(45) Date of Patent: Jun. 26, 2001

(54) APPARATUS FOR WITHDRAWING A LIQUID FROM A CLOSED CONTAINER

(75) Inventors: Johannes Geser, Dortmund; Heinrich Kladders, Muelheim, both of (DE)

(73) Assignee: Boehringer Ingelheim International GmbH, Ingelheim Am Rhein (DE)

( * ) Notice: Subject to any disclaimer, the term of this patent is extended or adjusted under 35 U.S.C. 154(b) by 0 days.

(21) Appl. No.: 09/061,172

(22) Filed: Apr. 16, 1998

(30) Foreign Application Priority Data

Apr. 16, 1997 (DE) ..... 197 15 893

(51) Int. Cl.[7] ..... B67D 5/58
(52) U.S. Cl. ..... 222/189.1; 222/464.2
(58) Field of Search ..... 222/189.1, 464.2, 222/464.1, 187; 210/416.3, 439, 446

(56) References Cited

U.S. PATENT DOCUMENTS

| | | | | |
|---|---|---|---|---|
| 32,752 | * | 7/1861 | Case | 222/189.1 |
| 1,019,171 | * | 3/1912 | Melville-Hamilton | 222/189.1 |
| 2,815,889 | * | 12/1957 | Stetz et al. | 210/416.3 |
| 3,095,328 | | 6/1963 | Tanchuk . | |
| 4,130,909 | | 12/1978 | Greene . | |
| 4,173,604 | | 11/1979 | Dimacopoulos . | |
| 4,418,846 | * | 12/1983 | Pong et al. | 222/189.1 |
| 4,714,550 | * | 12/1987 | Malson et al. | 210/416.3 |
| 4,739,928 | | 4/1988 | O'Neil . | |
| 5,122,272 | * | 6/1992 | Iana et al. | 210/416.3 |
| 5,611,687 | | 3/1997 | Wagner . | |
| 5,730,328 | * | 3/1998 | Maeder et al. | 222/464.2 |

FOREIGN PATENT DOCUMENTS

| | | | |
|---|---|---|---|
| 44 47 087 | | 7/1996 | (DE) . |
| 2 672 038 | | 7/1992 | (FR) . |
| 2 013 157 | | 8/1979 | (GB) . |
| 2013157 | * | 8/1979 | (GB) . |
| WO 86/00868 | | 2/1986 | (WO) . |

* cited by examiner

*Primary Examiner*—Kevin Shaver
*Assistant Examiner*—David Deal
(74) *Attorney, Agent, or Firm*—Sterne, Kessler, Goldstein & Fox P.L.L.C.

(57) ABSTRACT

For the withdrawal of a liquid from a closed container which is in a fluctuating position in space in a portable piece of equipment, precautions are to be taken so that the liquid can be withdrawn as completely as possible and in a trouble-free manner.

Figure 1:
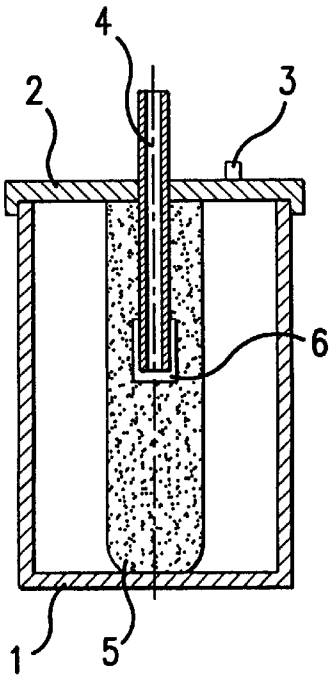

A closed container is provided with an open-pore porous storage medium which is in the form of an integral body. It preferably fills only a part of the container, it is disposed at least in the region of the end of the withdrawal connection portion, and it touches the liquid at least at times. The storage medium serves as a pre-storage means for the liquid and as a bubble barrier. It constantly holds a certain amount of the liquid in the proximity of the end of the withdrawal connection portion, even if the end thereof is above the level of liquid in the container.

The container provided with the storage medium can be used as an active substance deposit for a liquid medicament in an atomiser in the form of a hand unit, with which an inhalable aerosol can be produced.

14 Claims, 3 Drawing Sheets

APPARATUS FOR WITHDRAWING A LIQUID FROM A CLOSED CONTAINER

BACKGROUND OF THE INVENTION

1. Field of the Invention

The invention concerns an apparatus for withdrawing a liquid from a closed container. The container is provided with a withdrawal connection portion through which the liquid is taken from the container and passed for further use thereof. The container is in a fluctuating position in space if it is part of a portable piece of equipment.

The invention aims to make it possible to take a liquid from a closed container when the container is in any position in space so that the liquid withdrawn from the container can be used in the appropriate fashion and in a trouble-free manner.

2. Related Art

It is known for a liquid to be discharged downwardly from a rigid container through a discharge connection portion or to be withdrawn upwardly or laterally by means of a tube or hose which projects into the container. The discharged flow of liquid is bubble-free and uninterrupted as long as the liquid completely covers the discharge connection portion or as long as the end of the tube completely dips into the liquid. Those conditions can be easily observed when dealing with a container which is in a fixed position in space. The liquid in the container can be virtually completely withdrawn therefrom.

In portable pieces of equipment on the other hand a rigid liquid container can adopt any position in space. As long as one of the conditions specified for a container involving a fixed position in space is met, a bubble-free and uninterrupted flow of liquid can also be taken from a container whose position in space fluctuates. It is however not possible for the liquid in the container to be completely withdrawn therefrom.

It is further known to dispose in a rigid container a foil bag which contains the liquid and which collapses to the extent that liquid is taken from the foil bag (collapsible bag). Experience has shown that the liquid can no longer be withdrawn from the bag as soon as the foil comes to bear against the discharge connection or the end of the tube or hose. Experience has shown that this can occur before the foil bag is empty.

Accordingly an object of the invention is to provide an apparatus with which a liquid can be almost completely withdrawn from a closed container in a trouble-free manner, the container being provided with a withdrawal connection portion, containing a liquid and involving a position that fluctuates in space.

SUMMARY OF THE INVENTION

According to the invention that object is attained by a storage medium which has open-pore porosity and which is in the form of an integral body. The storage medium is disposed within the container at least in the region of the end of the withdrawal connection portion. It touches the liquid at least at times. For total withdrawal of the liquid the storage medium preferably bears against a part of the inside wall of the container.

The storage medium can be disposed outside the withdrawal connection portion in front of the end thereof and can surround the withdrawal connection portion which projects into the container, at least over a part of the length of the withdrawal connection portion, within the container. In another embodiment the storage medium fills the major part of the container volume. In a further embodiment the storage medium is disposed substantially in the interior of the withdrawal connection portion at the end thereof. In a further construction the storage medium is disposed in the interior of the withdrawal connection portion at the end thereof and surrounds the withdrawal connection portion which projects into the container, at least over a part of its length.

It may be desirable to provide a cavity in the storage medium in the region of the end of the withdrawal connection portion.

The storage medium is either a body of stable shape comprising sintered powder or a wadding, a fleece, a knitted portion or a woven portion of fibres or an open-pore body, for example a sponge. It may also be a non-sintered powder which completely fills a part of the container volume, in which case the partial volume filled with powder is separated from the remaining volume of the container by a liquid-permeable wall.

The powder or the fibres forming the storage medium may comprise plastic material, ceramic, glass, metal or a natural substance.

Powders of polyolefin or polyester are suitable as plastic powders for example. Powders of ceramic or glass, for example, of $Al_2O_3$, $SiO_2$, $TiO_2$ and Na-Al-silicate are also suitable. Metal powders may comprise Ni, Al, high-quality steel or bronze. The particle size is 0.5 to 500 $\mu$m.

Suitable fibres are those comprising plastic material, for example polyolefin or polyester, glass or metal or metal alloys, for example steel. The fibre diameter is 5 to 100 $\mu$m.

The withdrawal connection portion may be a rigid tube or a flexible hose. Instead of passing through the cover or through the bottom the withdrawal connection portion may pass through the container wall into the interior thereof at any location. The end of the withdrawal connection portion possibly terminates flush with the inside wall surface of the container. In that case the storage medium is fixed to the container wall in front of the end of the withdrawal connection portion.

If the container is rigid and if a considerable reduced pressure is not to occur in the container the container is provided with a vent valve which possibly operates automatically.

The storage medium is permeated by capillaries and serves as a pre-storage means for the liquid. It constantly holds a certain amount of the liquid in the proximity of the end of the withdrawal connection portion, even if the end of the withdrawal connection portion itself is above the level of liquid in the container. When the container is in that spatial position the liquid is withdrawn from the storage medium. As soon as the spatial position of the container changes and the storage medium is again in contact with liquid, it sucks itself full again with liquid.

The storage medium preferably fills only a part of the container volume.

The apparatus according to the invention has the following advantages:

- it permits the withdrawal connection portion to be supplied with liquid, irrespective of position, as long as the maximum possible volume flow in the withdrawal connection portion is less than the maximum possible volume flow of the liquid in the storage medium,
- the liquid can be withdrawn, free from gas bubbles, the storage medium serving as a bubble barrier, the liquid can also be withdrawn virtually completely and in a trouble-free manner from a foil bag, the storage medium acts as a filter for the liquid, and the liquid can be virtually completely withdrawn from the container by means of a storage medium which bears against a part of the inside wall surface of the container.

The apparatus according to the invention is a particularly attractive proposition for the storage of a medicament dissolved in a solvent, for producing an aerosol for inhalative application. Suitable solvents are for example water or ethanol or mixtures thereof. Suitable medicaments are for example Berotec, Atrovent, Berodual, Salbutamol, Combivent, Oxivent, Ba 679, BEA 2108 and others.

The apparatus according to the invention can be used in a particular embodiment as an active substance deposit for atomisers, as are disclosed for example in PCT application WO91/14468 or PCT/EP96/04351. Even when withdrawing small amounts of liquid in the range of between 10 and 40 microliters the apparatus according to the invention guarantees that the solution is taken in a bubble-free condition from the storage medium which is generally of a volume of between 2 and 6 milliliters.

DETAILED DESCRIPTION OF THE PREFERRED EMBODIMENTS

The apparatus according to the invention will now be described in greater detail by way of example with reference to the drawings.

FIG. 1 is a view in axial section through a cylindrical container 1 with a flat bottom, which is closed by a cover 2. A vent valve 3 is mounted in the cover. A withdrawal connection portion 4 is in the form of a rigid tube which is fixed in the cover 2 and which projects into the container 1. Over its entire length in the container, the withdrawal connection portion 4 is surrounded by the storage medium 5 which is in the form of a cylindrical body and which touches the bottom of the container. A cavity 6 is provided in the storage medium in the area around the end of the withdrawal connection portion 4.

Figure 2:
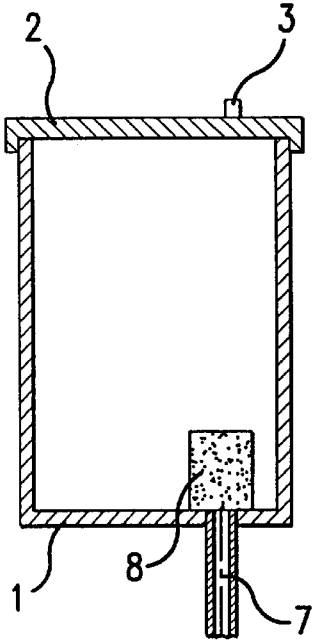

FIG. 2 shows a further embodiment of the apparatus according to the invention. The withdrawal connection portion 7 is disposed in the bottom of the container. The storage medium 8 is fixed on the bottom of the container 1 is disposed in front of the end of the withdrawal connection portion 7 which does not project into the container.

Figure 3:
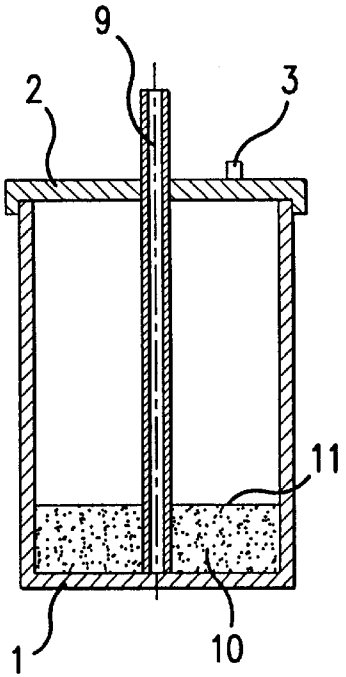

FIG. 3 shows an embodiment in which the rigid withdrawal connection portion 9 extends almost as far as the bottom of the container 1. The withdrawal connection portion 9 terminates in a storage medium 10 in powder form, on which there lies a liquid-permeable wire mesh 11 which is connected at its edge to the container wall. A wire mesh is also disposed in front of the intake end of the withdrawal connection portion 9. The wire meshes retain the storage medium in powder form in the part of the volume of the container, which is provided therefor.

Figure 4:
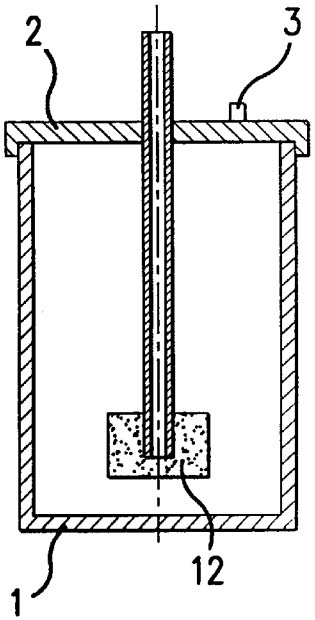

FIG. 4 shows a further embodiment. In this case, however, the storage medium 12 does not touch the bottom of the container 1.

Figure 5A:
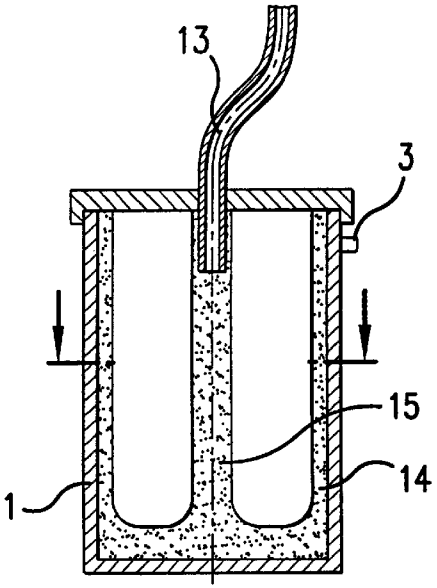
Figure 5B:
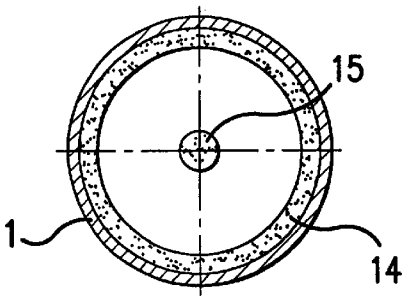

FIG. 5*a* shows an axial longitudinal section through a cylindrical container 1 and FIG. 5*b* is a view in cross-section taken perpendicularly to the axis of the container 1 in the plane indicated in FIG. 5*a*. The withdrawal connection portion 13 is flexible. The one-piece storage medium 14 is disposed at the end of the withdrawal connection portion 13, which extends into the container 1. The storage medium 14 touches the cylindrical inside wall surface and the bottom of the container 1 is of a bar-like configuration on the axis of the container 1, it extends as far as the cover of the container and it surrounds the end of the withdrawal connection portion 12.

Figure 6A:
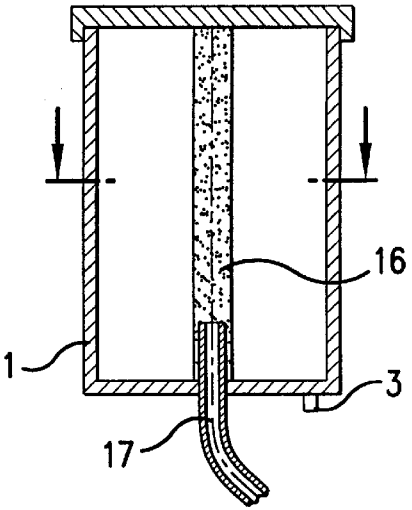
Figure 6B:
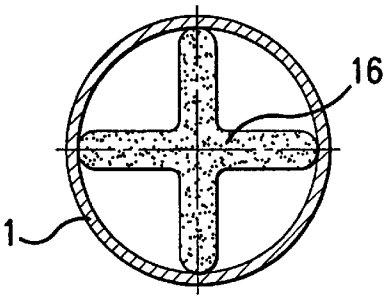

FIG. 6*a* is an axial longitudinal section through a cylindrical container 1 and FIG. 6*b* is a cross-section taken perpendicularly to the axis of the container 1 in the plane indicated in FIG. 6*a*. In this case the one-piece storage medium 16 is of a cross-section formed by four arms. The end of the withdrawal connection portion 17 which is disposed in the bottom of the container 1 is surrounded by the storage medium 16. The limbs of the storage medium 16 touch the inside wall surface and the bottom of the cylindrical container 1.

Figure 7A:
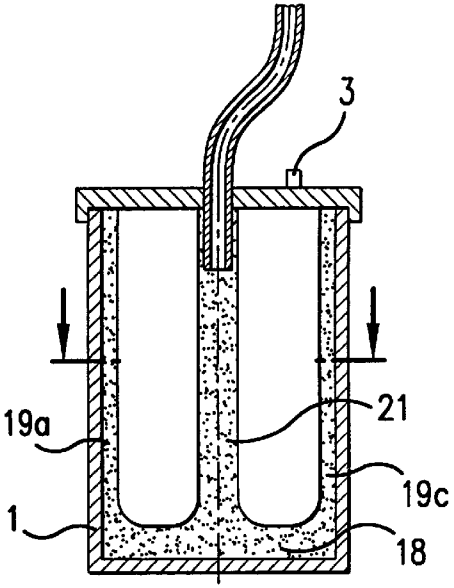
Figure 7B:
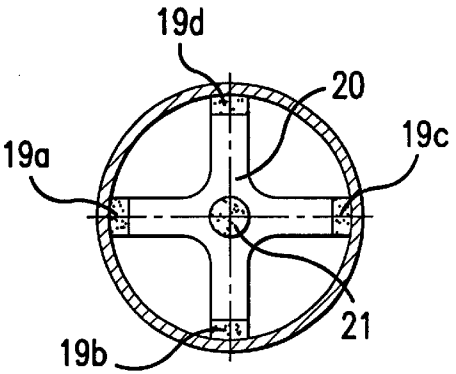

FIG. 7*a* shows an axial longitudinal section through a cylindrical container 1 and FIG. 7*b* shows a cross-section perpendicularly to the axis of the container 1 in the plane indicated in FIG. 7*a*. The apparatus according to this embodiment of the invention is of a similar design configuration to that shown in FIGS. 5*a* and 5*b*. The one-piece storage medium 18 comprises four bars 19*a*, 19*b*, 19*c* and 19*d* which touch the inside wall surface of the container 1 and extend from the cover to the bottom. At the bottom of the container 1 the bars go into a four-armed star 20, from which a cylindrical bar 21 projects at the centre. The cylindrical bar 21 extends as far as the cover of the container 1 and surrounds the end of the withdrawal connection portion.

Figure 8:
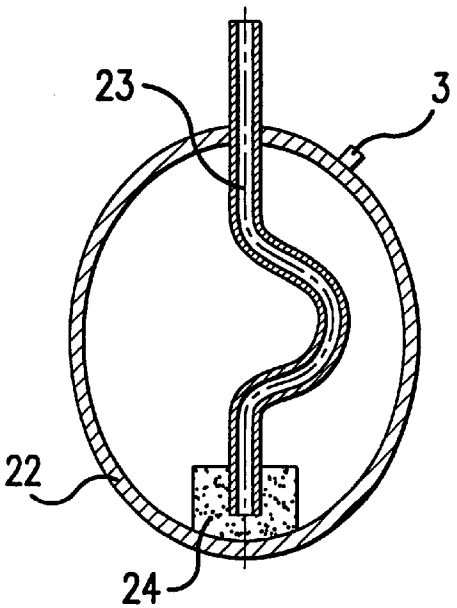

FIG. 8 shows a longitudinal section through an egg-shaped container 22, into which a flexible withdrawal connection portion 23 projects. The storage medium 24 is disposed at the end of the connection portion 23. Irrespective of the position of the container 22 the storage medium 24 constantly touches the inside wall surface of the container 22 in the region in which the liquid is to be found.

Figure 9:
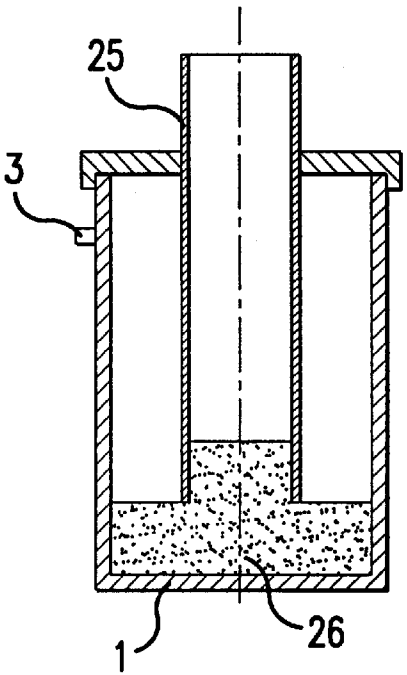

FIG. 9 shows an axial longitudinal section through a cylindrical container 1, into which a withdrawal connection portion 25 projects. Disposed at the end of the withdrawal connection portion 25 is the storage medium 26 which touches the bottom of the container 1 and which fills the end of the withdrawal connection portion 25.

Figure 10:
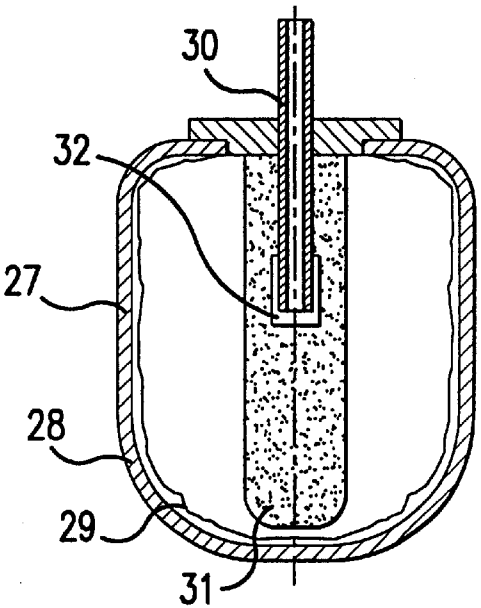

FIG. 10 shows an axial longitudinal section through a container 27, the bottom 28 of which is curved. Disposed in the container 27 is a foil bag 29 filled with the liquid. The withdrawal connection portion 30 projects through the cover into the container 27, the end thereof being surrounded by the cylindrical storage medium 31. A cavity 32 is provided in the storage medium 31 at the end of the withdrawal connection portion 30.

EXAMPLE 1

Apparatus for Aerosol Production

An aerosol is produced from a liquid by the liquid flowing under high pressure through a nozzle and being atomised outside the nozzle. The high pressure required for that purpose in the liquid can be achieved only if the liquid is withdrawn from the container in a bubble-free condition.

The aerosol producer is provided with an apparatus as shown in FIG. 1. The storage medium comprises sintered polyethylene. Commercially available polyethylene powder (manufacturer: Hoechst AG, Type GUR 4120) is of a mean grain size of 120 $\mu$m. In this case the apparatus according to the invention serves as a bubble barrier and a pre-storage means for the liquid.

EXAMPLE 2

Apparatus for Withdrawing a Liquid Under a Protective Gas

A deformable foil bag is filled to approximately 80% of its volume with a liquid which is under a protective gas and which is to be taken dropwise from the bag. At its discharge end the withdrawal connection portion has a non-return valve. The storage medium in the form of a felt ball of polyester fibre of a diameter of 18 $\mu$m is fixed to the end of the withdrawal connection portion, which projects into the bag.

When the bag is compressed by hand the liquid issues dropwise from the withdrawal connection portion. The bag collapses to the extent that liquid is taken therefrom. The non-return valve at the discharge end of the withdrawal connection portion prevents air from penetrating into the foil bag. After each actuation of the apparatus, the felt ball at the intake end of the withdrawal connection portion is sucked full of liquid again. The felt ball acts as a pre-storage means for the liquid and as a barrier for the protective gas. It contains more liquid than is taken from the felt ball upon actuation of the apparatus.

The felt ball storage medium permits the liquid present in the bag to be virtually completely withdrawn therefrom. It also prevents the intake end of the withdrawal connection portion from being closed off by the foil disposed in front of same. The protective gas issues through the withdrawal connection portion only when the liquid has been virtually totally withdrawn from the foil bag.

What is claimed is:

1. Apparatus for withdrawing a liquid from a closed container containing the liquid, comprising:

a withdrawal connection portion that projects into the container; and a storage medium which has open-pore porosity and is in the form of an integral body, said storage medium being disposed within the container at least in the region of an end of the withdrawal connection portion with at least a portion of said storage medium being disposed outside said withdrawal connection portion, wherein said storage medium is in contact with the liquid at least at times.

2. Apparatus according to claim 1 wherein said storage medium touches an inside wall surface of the container.

3. Apparatus according to claim 1 wherein said storage medium surrounds a portion of the withdrawal connection portion that projects into the container.

4. Apparatus according to claim 1, wherein said storage medium fills a major part of the volume of the container.

5. Apparatus according to claim 4, wherein said storage medium surrounds a portion of the withdrawal connection portion that projects into the container, at least over a part of a length of the withdrawal connection portion.

6. Apparatus according to claim 1 wherein said storage medium is also disposed in an interior of the withdrawal connection portion.

7. Apparatus according to claim 1, further comprising a cavity in said storage medium in the region of the end of the withdrawal connection portion.

8. Apparatus according to claim 1 wherein said storage medium comprises a body of stable shape, said body including sintered powder as said storage medium.

9. Apparatus according to claim 8 wherein said powder forming the storage medium comprises at least one of the following: plastic material, ceramic, glass, metal and a natural substance.

10. Apparatus according to claim 1, wherein said storage medium comprises a body of stable shape, said body including a non-sintered powder as said storage medium which completely fills a part of the volume of the container, wherein the partial volume filled with said powder is separated from the rest of the volume of the container by a liquid-permeable wall.

11. Apparatus according to claim 10 wherein said powder forming the storage medium comprises at least one of the following: plastic material, ceramic, glass, metal and a natural substance.

12. Apparatus according to claim 1, wherein said storage medium comprises one of the following: a woven portion, a knitted portion, a fleece and a wadding of fibres.

13. Apparatus according to claim 12, wherein said fibres forming the storage medium comprises at least one of the following: plastic material, ceramic, glass, metal, and a natural substance.

14. Apparatus according to claim 1, wherein said withdrawal connection portion is a rigid tube or flexible hose.

* * * * *